United States Patent [19]

Knox

[11] Patent Number: 4,804,122

[45] Date of Patent: Feb. 14, 1989

[54] THEFT PROTECTION PURSE

[76] Inventor: Renior L. Knox, 3008 John, Corpus Christi, Tex. 78407

[21] Appl. No.: 123,770

[22] Filed: Nov. 23, 1987

[51] Int. Cl.[4] ..... A45C 1/02; A45C 1/04; A45C 13/20

[52] U.S. Cl. ..... 224/220; 224/267; 224/901; 150/101; 150/102; 150/111; 150/134; 190/101

[58] Field of Search ..... 190/101, 102; 150/100–102, 106, 111, 117, 133, 134, 113, 116; 224/217–222, 267, 901

[56] References Cited

U.S. PATENT DOCUMENTS

| | | | |
|---|---|---|---|
| 330,808 | 11/1885 | Stouekew | 150/102 |
| 394,043 | 12/1888 | Whitcock | 150/102 |
| 463,169 | 11/1891 | Scott | 150/102 |
| 475,503 | 5/1892 | Hock | 150/102 |
| 1,213,758 | 1/1917 | Delaney | 150/134 |
| 1,397,369 | 11/1921 | Diamond | 150/117 |
| 1,538,518 | 5/1925 | Marymont | 150/117 |
| 1,643,106 | 9/1927 | Williams | 190/101 |
| 1,927,624 | 9/1933 | Appel | 150/117 |
| 2,130,502 | 9/1938 | Lindemann | 150/117 |
| 2,413,465 | 12/1946 | Ohlsen | 150/106 X |
| 2,461,588 | 2/1949 | Cooper | 150/102 X |
| 2,779,523 | 1/1957 | Klimkiewicz | 150/102 X |
| 2,796,905 | 6/1957 | Hebron | 150/133 |
| 3,286,751 | 11/1966 | Dishart | 150/102 X |
| 3,744,132 | 7/1973 | Korth | 150/102 X |
| 3,881,534 | 5/1975 | Gist | 190/101 X |
| 4,257,463 | 3/1981 | Monaco | 150/111 |
| 4,263,951 | 4/1981 | Siegel | 150/111 |

FOREIGN PATENT DOCUMENTS

| | | | |
|---|---|---|---|
| 2213610 | 9/1973 | Fed. Rep. of Germany | 150/134 |
| 584792 | 2/1925 | France | 150/102 |
| 7245 | of 1884 | United Kingdom | 150/111 |

*Primary Examiner*—Sue A. Weaver

*Attorney, Agent, or Firm*—Leon Gilden

[57] ABSTRACT

A theft protection purse is set forth wherein a secondary purse is positionable within a compartment of said purse including a Velcro (TM) securable flap encloses said secondary purse for access thereto. Said secondary purse includes a flexible tether selectively securable to a bracelet to be worn by a user. Alternatively, the tether may be disconnected from said bracelet and positioned upon a hook within said Velcro secured enclosure compartment.

3 Claims, 1 Drawing Sheet

10
12
11
C
17
18
15
13

12
13
17

16
17a
14
18
22
11
21
19
15
19
15

15
20

THEFT PROTECTION PURSE

BACKGROUND OF THE INVENTION

1. Field of the Invention

The present invention relates to purses and more particularly pertains to a new and improved theft protection purse wherein a secondary purse is positionable within a pocket of said first purse and securable by a flexible tether line to a user of said purse to prevent theft thereof.

2. Description of the Prior Art

The use of theft protection devices in association with purses and the like is well known in the prior art. As may be appreciated, these devices in the past have normally required expansive structure or bulky and awkward arrangements to effect their use. In this connection, there have been several attempts to develop theft protection purses and the like which may be easily and efficiently utilized when desired. For example, U.S. Pat. No. 330,808 to Stoveken illustrates an early securement means of securing a purse by means of a pin and jaw arrangement to the garment of a wearer. The purse of this type is inconvenient to utilize and ineffective against theft as a purse may be easily torn from a garment it is secured to as opposed to the instant invention.

U.S. Pat. No. 394,043 to Whitlock illustrates the use of a flexible line that is to be worn about the head and in turn secured to the purse to prevent the purse from being stolen and secondarily, provide a more convenient means of carrying the purse about. The clearly obvious and awkward use of the device as well as the inherently conspicuous manner of protection limits its acceptance by contemporary society.

U.S. Pat. No. 463,169 to Scott illustrates the use of a chain securable to a purse wherein said chain may be secured to the apparel or the like of a user of the purse of Scott. This patent as well as others of this class ar not readily acceptable and are limited by their obvious means of maintaining the purse and in general do not tend to prevent theft as the purse itself is taken during a robbery procedure, as opposed to the present invention which allows a would-be thief to take what he believes to be the valuables while in essence allowing a user of the instant invention to keep such valuables by means of the secondary purse arrangement.

U.S. Pat. No. 2,461,588 to Cooper is another approach in purse protection as upon opening the purse an accordion-like diaphragm is actuated to effect a sounding device associated therewith.

U.S. Pat. No. 2,779,523 illustrates the use of a mere bracelet securing a purse about the wrist of a user. U.S. Pat. No. 3,286,751 to Dishart illustrates a purse or wallet secured by a chain-like tether to a ring or belt loop or the like of a user. The patents to Kilmkiewicz and Dishart are similar and are, as other prior devices limited in its effectiveness to enable a would-be thief to run away with a bogus purse leaving the user thereof unharmed in the process.

U.S. Pat. No. 3,744,132 to Korth illustrates the use of a purse theft protection device wherein a plurality of blade actuated devices enables the knives to be brought into play and cut the hand of a would-be thief upon attempted robbery. The Korth device may be as dangerous to the user as to the thief.

As such, it may be appreciated that there is a continuing need for a new and improved theft protection purse device which addresses both the problem of compactness and effectiveness and in this respect the present invention substantially fulfills this need.

SUMMARY OF THE INVENTION

In view of the foregoing disadvantages inherent in the known types of theft prevention purses now present in the prior art, the present invention provides an theft prevention purse wherein the same may compactly and efficiently store a secondary purse securable to a user that may be efficiently and easily stored within the first purse and effectively removed therefrom during a period of use or theft activity. As such, the general purpose of the present invention, which will be described subsequently in greater detail, is to provide a new and improved theft prevention purse which has all the advantages of the prior art theft prevention purses and none of the disadvantages.

To attain this, the present invention comprises a first purse formed with a storage compartment in a conventional manner with the addition of a secondary compartment and an overlying flap to conceal the secondary compartment formed at a terminal end of said purse. Within said compartment a secondary purse is positionable therein and said secondary purse being secured to a user by means of a chain link or tether line such that access to the compartment is readily effected by opening of the flap to gain access to the purse or is readily removed from the purse during a theft procedure due to the flap being secured to the purse by fabric-like hook and loop connectors known as Velcro (T.M.) attachment means.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purpose of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved theft protection purse which has all the advantages of the prior art theft protection purses and none of the disadvantages.

It is another object of the present invention to provide a new and improved theft protection purse which may be easily and efficiently manufactured and marketed.

It is a further object of the present invention to provide a new and improved theft protection purse which is of a durable and reliable construction.

An even further object of the present invention is to provide a new and improved theft protection purse which is susceptible of a low cost of manufacture with regard to both materials and labor, and which accordingly is then susceptible of low prices of sale to the consuming public, thereby making such theft protection purses economically available to the buying public.

Still yet another object of the present invention is to provide a new and improved theft protection purse which provides in the apparatuses and methods of the prior art some of the advantages thereof, while simultaneously overcoming some of the disadvantages normally associated therewith.

Still another object of the present invention is to provide a new and improved theft protection purse wherein a first purse has formed therein a secondary compartment with an overlying Velcro (T.M.) attachable covering flap.

Still another object of the present invention is to provide a new and improved theft protection purse wherein a second purse is positionable within a secondary compartment formed in the first purse and readily removable therefrom when access is desired or during a theft of the first purse is attempted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4:
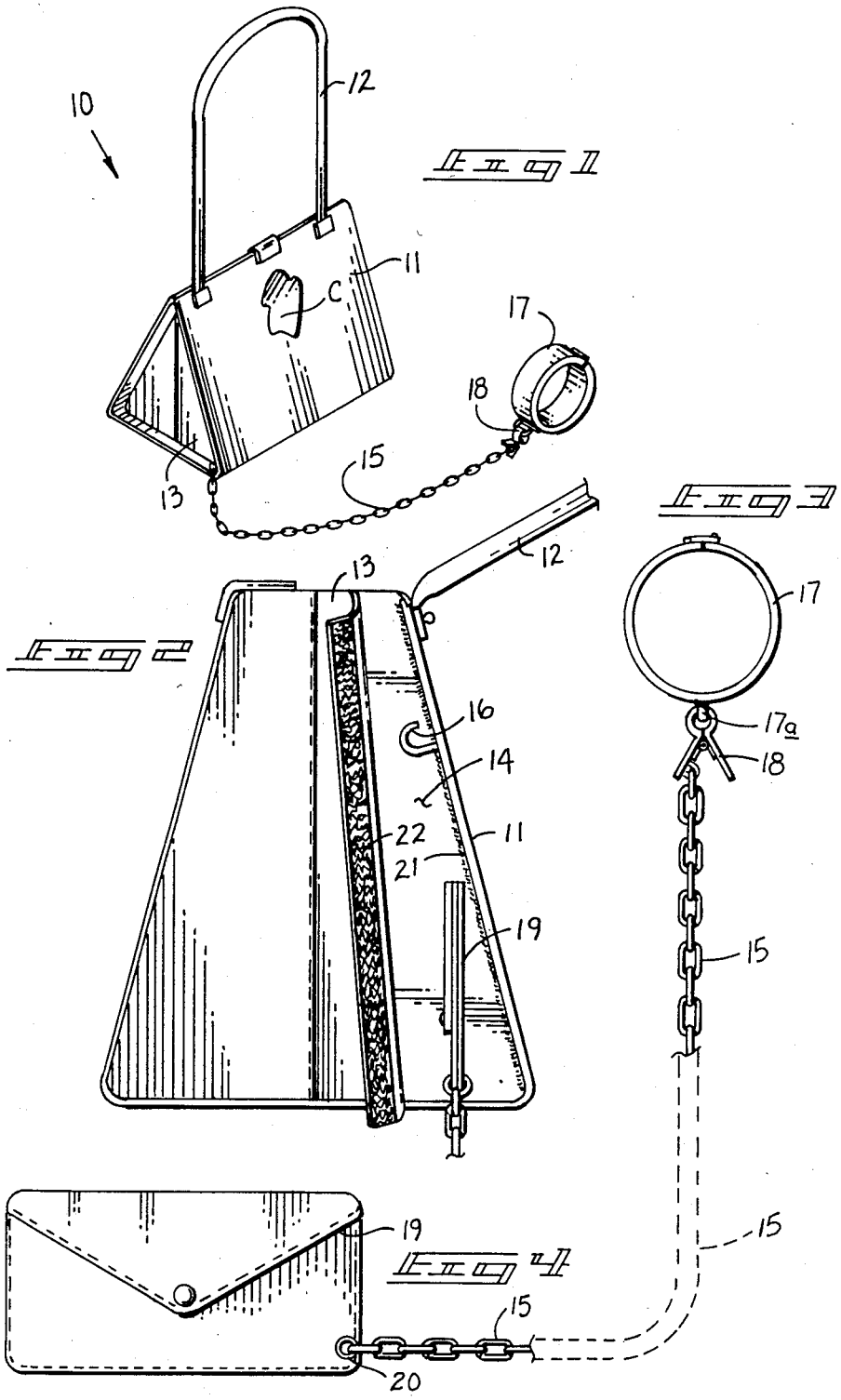
FIG. 1 is an isometric view of the instant invention illustrating a first purse and a tether line positionable therein formed with a bracelet attachable to a user.
FIG. 2 is an orthographic side view of the instant invention illustrating a covering flap opened partially to illustrate the positioning of a secondary purse therein.
FIG. 3 is an orthographic side view illustrating the bracelet and tether line of the instant invention.
FIG. 4 an orthographic view of the secondary purse of the instant invention secured to a tether line.

With reference now to the drawings, and in particular to FIG. 1 thereof, a new and improved theft protection purse embodying the principles and concepts of the present invention and generally designated by the reference numeral 10 will be described.

More specifically, it will noted that the theft protection purse 10 essentially comprises a first purse 11 formed in a conventional manner including a first compartment C. The exterior configuration of first purse 11 and an associated handle 12 is of conventional construction subject to change for purposes of fashion and convenience. Emanating from within a second compartment 14 (as illustrated in FIG. 2) is a tether line or chain selectively associated to a bracelet 17 to be worn around the wrist of a user with a spring clip 18 attaching said tether line 15 to said bracelet.

With attention to FIG. 2, a compartment covering flap 13 is in a flexible overlying relationship to second compartment 14 formed within an end portion of purse 11. A hook 16 is formed interiorly of a side wall of purse 11, as illustrated in FIG. 2, within compartment 14 wherein the spring clip 18 may be removed from bracelet 17 and secured conveniently upon hook 16 when a user is not desirous of mechanically attaching the theft protection purse apparatus 10 to bracelet 17. Bracelet 17 may also be of any convenient construction for purposes of fashion and the like and is merely provided with an appropriate ring portion **17*a* to enable securement of the aforenoted spring clip 18 thereto. Tether line 15 mechanically attaches to spring clip 18 at one end and to a second purse 19 at its other end to a reenforced grommet 20 formed within second purse 19. Compartment covering flap 13 has formed thereto Velcro (T.M.) fabric loops 22 to selectively and mechanically join to fabric-type Velcro hooks 21 formed within purse 11 at interior thereof to enable securement of flap 13** in an inconspicuous manner.

As to the manner of usage and operation of the present invention, the same should be apparent from the above description. Briefly, the second purse 19 will be the repository of all money and valuables to be transported by a user and positioned within compartment 14. The user then attaches bracelet 17 about his/her wrist and should an attempted theft occur, purse 11 being the obvious storage of valuables to be taken whereupon tether line 15 becomes taut. Second purse 19 is ripped from within compartment 14 as the connection of the aforenoted hooks 21 and loops 22 are of less strength then the tether line or chain link connection 15.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A theft prevention purse apparatus comprising a first purse including a storage compartment, a handle, and first and second side walls, and first and second end walls, and a separate recessed second compartment formed within one of said end walls including covering flap means configured and arranged in the same plane as one of said end walls, said covering flap means including releasably securing means to associate said flap means with said first purse, and a second purse dimensionally smaller than said first purse proportioned to fit within said recessed second compartment, and a tether line securable to said second purse at one end and to a ring means at the other end, said ring means proportioned for fitting about selective portions of an individual's anatomy, and wherein said releasably securing means of said flap means includes hook and loop fastening means to secure said flap means to said first purse, and wherein a stationary fixed hook is positioned within said second compartment for selective attachment of said tether line, and wherein said tether line is securable to said ring means by means of a releasable spring fastener means for removing said spring fastener means from said ring means for attachment to said hook.

2. A theft prevention purse as set forth in claim 1 wherein said tether line is attached to said second purse by means of a re-enforced grommet.

3. A theft prevention purse as set forth in claim 1 wherein said flap means is formed in the same plane as said end wall and comprises substantial one-half of the surface area of said end wall.

* * * * *